US007834532B2

(12) United States Patent
Onishi

(10) Patent No.: US 7,834,532 B2
(45) Date of Patent: Nov. 16, 2010

(54) ELECTRON BEAM DISPLAY

(75) Inventor: Tomoya Onishi, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 12/402,978

(22) Filed: Mar. 12, 2009

(65) Prior Publication Data

US 2009/0251041 A1 Oct. 8, 2009

(30) Foreign Application Priority Data

Apr. 3, 2008 (JP) ..... 2008-097025

(51) Int. Cl.
*H01J 29/10* (2006.01)

(52) U.S. Cl. ..... 313/473; 313/496

(58) Field of Classification Search ..... 313/495–496, 313/461, 463, 473
See application file for complete search history.

(56) References Cited

U.S. PATENT DOCUMENTS

2005/0280349 A1 12/2005 Nishikawa et al.
2007/0035232 A1 2/2007 Jeon et al.
2008/0084156 A1 4/2008 Choi et al.

FOREIGN PATENT DOCUMENTS

| | | | |
|---|---|---|---|
| CN | 1913092 | A | 2/2007 |
| CN | 101162678 | A | 4/2008 |
| JP | 11-339683 | A | 12/1999 |
| JP | 2006-4804 | A | 1/2006 |
| KR | 10-0818258 | B1 | 3/2008 |

*Primary Examiner*—Vip Patel
(74) *Attorney, Agent, or Firm*—Fitzpatrick, Cella, Harper & Scinto

(57) ABSTRACT

An electron beam display, in which light extracting efficiency from phosphor and a bright-portion contrast are improved is provided, has: an electron-emitting device, a metal back, and a phosphor dot which is disposed in opposition to the electron-emitting device through the metal back and emits light responsive to an irradiation with an electron beam emitted from the electron-emitting device; and further has a face plate having a black member which is disposed in opposition to the electron source through the phosphor dot and has an aperture in a region in which the phosphor dot is formed. A region irradiated with the electron beam emitted from the electron-emitting device is not larger than the phosphor dot, a part of the black member is disposed in the region irradiated with the electron beam, and at least a part of the aperture is disposed outside of the region irradiated with the electron beam.

9 Claims, 8 Drawing Sheets

ELECTRON BEAM DISPLAY

BACKGROUND OF THE INVENTION

1. Field of the Invention

The present invention relates to an electron beam display in which an external light reflection has been suppressed.

2. Description of the Related Art

As for image display apparatuses such as a CRT, the realization of a further larger size of a display screen is demanded and studies to realize it are vigorously being performed. In association with the realization of the large size, it is an important object to realize a thin size, a light weight, and low costs. However, in the CRT, since an electron accelerated by a high voltage is deflected by a deflecting electrode and phosphor on a face plate is excited, if the screen size is enlarged, a depth is necessary in principle and it is difficult to realize the thin size and the light weight. As an image display apparatus which can solve the above problems, the inventors et al. have studied with respect to a surface conduction electron-emitting device and an image display apparatus using the surface conduction electron-emitting devices.

In recent years, various kinds of units for improving image characteristics such as luminance and contrast in a thin-type image display apparatus (flat panel display) have been proposed.

Patent Document 1 {Japanese Patent Application Laid-Open No. 2006-004804 (corresponding U.S. Patent Application Publication No. US-2005-0280349)} discloses such a technique that an occupation area of a black matrix is set to a value within a range of 60% to 95%, a metal film is formed on the black matrix, an aperture and a plurality of small holes are provided for the black matrix, and extracting efficiency of light is improved.

Patent Document 2 (Japanese Patent Application Laid-Open No. H11-339683) discloses a phosphor screen surface including: a black matrix film; a light reflecting film formed on the black matrix film; a phosphor film; and a rear light reflecting film (metal back). According to the invention of Patent Document 2, the light extracting efficiency is improved by a structure of the metal back.

Although both of the image display apparatuses disclosed in Patent Documents 1 and 2 mentioned above intend to improve the extracting efficiency of the light from the phosphor, in recent years, it is demanded to further improve display characteristics.

To improve a contrast of a bright portion, it is necessary to increase an occupation ratio of the black matrix, that is, decrease an aperture ratio. However, if the aperture ratio is merely decreased, light emission of the phosphor is obstructed and the light extracting efficiency deteriorates.

SUMMARY OF THE INVENTION

It is, therefore, an object of the present invention to provide an electron beam display in which light extracting efficiency from phosphor and a bright-portion contrast have been improved.

To accomplish the above object, an electron beam display according to the present invention has: an electron source; a metal back; and a phosphor dot which is disposed in opposition to the electron source through the metal back and emits light responsive to an irradiation with an electron beam emitted from the electron source. The electron beam display according to the present invention further has a face plate having a black member which is disposed in opposition to the electron source through the phosphor dot and has an aperture in a region in which the phosphor dot is formed. In such an electron beam display, a region irradiated with the electron beam emitted from the electron source is not larger than the phosphor dot, a part of the black member is disposed in the region irradiated with the electron beam, and at least a part of the aperture is disposed outside of the region irradiated with the electron beam.

According to the present invention, the light extracting efficiency from the phosphor and the contrast of the bright portion can be improved.

Further features of the present invention will become apparent from the following description of exemplary embodiments with reference to the attached drawings.

DESCRIPTION OF THE EMBODIMENTS

An exemplary embodiment of the present invention will be described hereinbelow.

An electron beam display of the present invention incorporates a field emission type electron beam display (FED), a surface conduction electron-emitting display (SED), a cathode ray tube display (CRT), and the like. Particularly, the FED and SED are forms which are desirable to apply the present invention from a viewpoint that an electron beam can be easily irradiated (converged) to a desired position. As an electron-emitting source which is used in the FED, a spint type, an MIM type, a carbon nanotube type, a ballistic electron surface emitting (BSD) type, and the like can be mentioned.

As an embodiment of the present invention, an electron beam display using surface conduction electron-emitting devices will be described as an example with reference to FIGS. 1A, 1B, and 2.

Figure 1A:
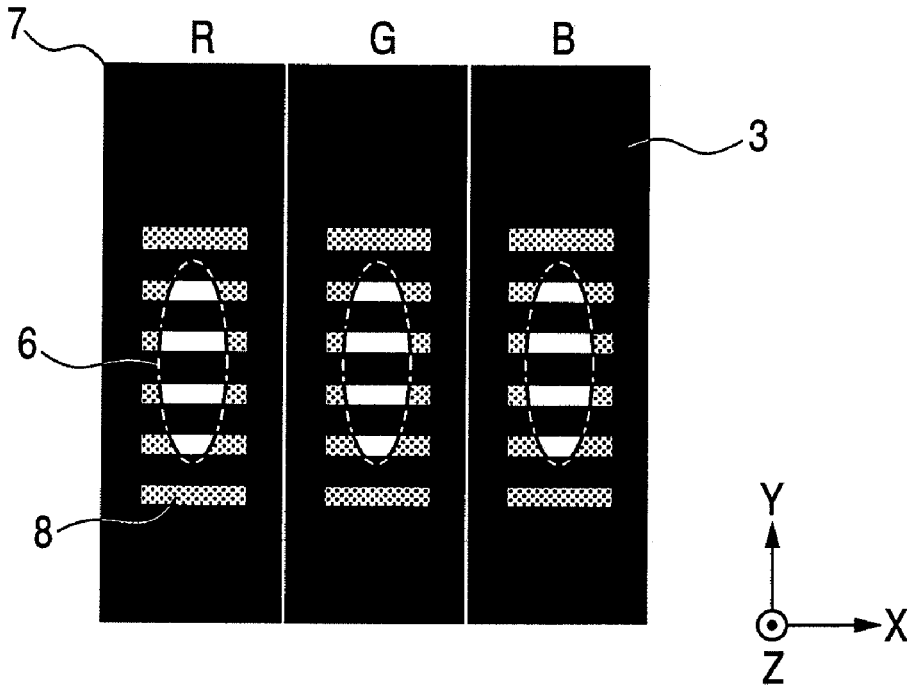
FIGS. 1A and 1B are a schematic plan view and a schematic cross sectional view of an electron beam display according to the present invention.

FIG. 1A is a schematic plan view illustrating a state where an electron beam is irradiated to a face plate 1 according to the present invention and the face plate emits light. FIG. 1B is a schematic cross sectional view illustrating a cross section of the face plate 1 in the electron beam display of the present invention and a trajectory 5 of the electron beam.

In the diagrams, a plane direction of the face plate 1 is set to the XY directions and a direction of a gap between the face plate 1 and a rear plate 9 provided with electron-emitting devices 10 is set to the Z direction.

The face plate 1 is provided with: phosphor 2 to which the electron beam is irradiated and emits the light; a black member 3; and a metal back 4. As a material of the face plate 1, in order to allow the light emitted from the phosphor to pass through and observe the transmitted light, a transparent insulating substrate is desirably used and plate glass such as soda-lime glass is desirably used. Besides, glass with a high strain point which is used in the field of a PDP (Plasma Display Panel) or the like is also desirably used.

The phosphor 2 is a material which emits the light by being irradiated by the electron beam and forms an image. A phosphor dot 20 is constructed by a plurality of phosphor particles 2. As phosphor 2, powdery phosphor which emits the light by an electron beam excitation such as P22 phosphor which is used in the CRT is desirably used. As a material similar to such a material, thin film phosphor which is produced by being directly formed onto the face plate 1 is also desirably used. Particularly, the P22 phosphor can be desirably used because it has excellent light-emitting color, light-emitting efficiency, color balance, and the like owing to the development of the CRT. The phosphor 2 is formed by a screen printing method, a photolithography method, an ink-jet method, or the like. Particularly, the screen printing method is desirably used from a viewpoint of a material using efficiency.

The black member 3 is also called a black matrix, a black stripe, or the like and is provided in order to raise a bright-portion contrast by absorbing the external light and prevent color mixture of the phosphor. In the black member 3, a plurality of apertures 8 are formed in a region where the phosphor dot 20 has been formed. As a black member 3, carbon black, a paste containing a black pigment and a glass frit with a low melting point, or the like is used. The black member 3 is formed by the screen printing method, photolithography method, or the like. Particularly, a black member obtained by mixing a photosensitive resin to the paste containing the black pigment and the glass frit with the low melting point is desirably used because patterning can be easily performed.

To improve the bright-portion contrast, it is necessary to increase an occupation ratio of the black member 3, that is, decrease an aperture ratio. However, if the aperture ratio is merely decreased, the light emission of the phosphor is obstructed. It is, therefore, required to reduce the light-shielding and raise the extracting efficiency of the light as much as possible. The improvement of the light extracting efficiency will be described hereinlater.

The metal back 4 is a member provided to apply an accelerating voltage for accelerating an electron emitted from the rear plate 9 and reflect the light emitted in the direction of the rear plate 9 in the light emitted from the phosphor 2 to the face plate 1 side. In the metal back 4, since it is necessary to improve reflectance of the light while reducing an energy loss of the accelerated electron beam as much as possible, a thin-film-like metal is desirably used. As a metal back 4, aluminum which can reduce the energy loss of the electron is particularly desirably used. The metal back 4 is formed by using a filming method, a transfer method, or the like which is well known in the CRT. Particularly, the filming method using a resin intermediate film is desirably used because the reflectance of the metal back 4 can be improved.

The electron-emitting devices (electron source) 10 are provided on the rear plate 9 disposed in opposition to the face plate 1.

Subsequently, the electron beam emitted from the electron-emitting device (electron source) 10 will be described. The electron beam emitted from the electron-emitting device 10 flies as illustrated by the trajectory 5, is irradiated to the phosphor dot 20 on the face plate 1, and a light-emitting region by the electron beam is obtained.

The region irradiated with the electron beam will now be described.

Figure 2:
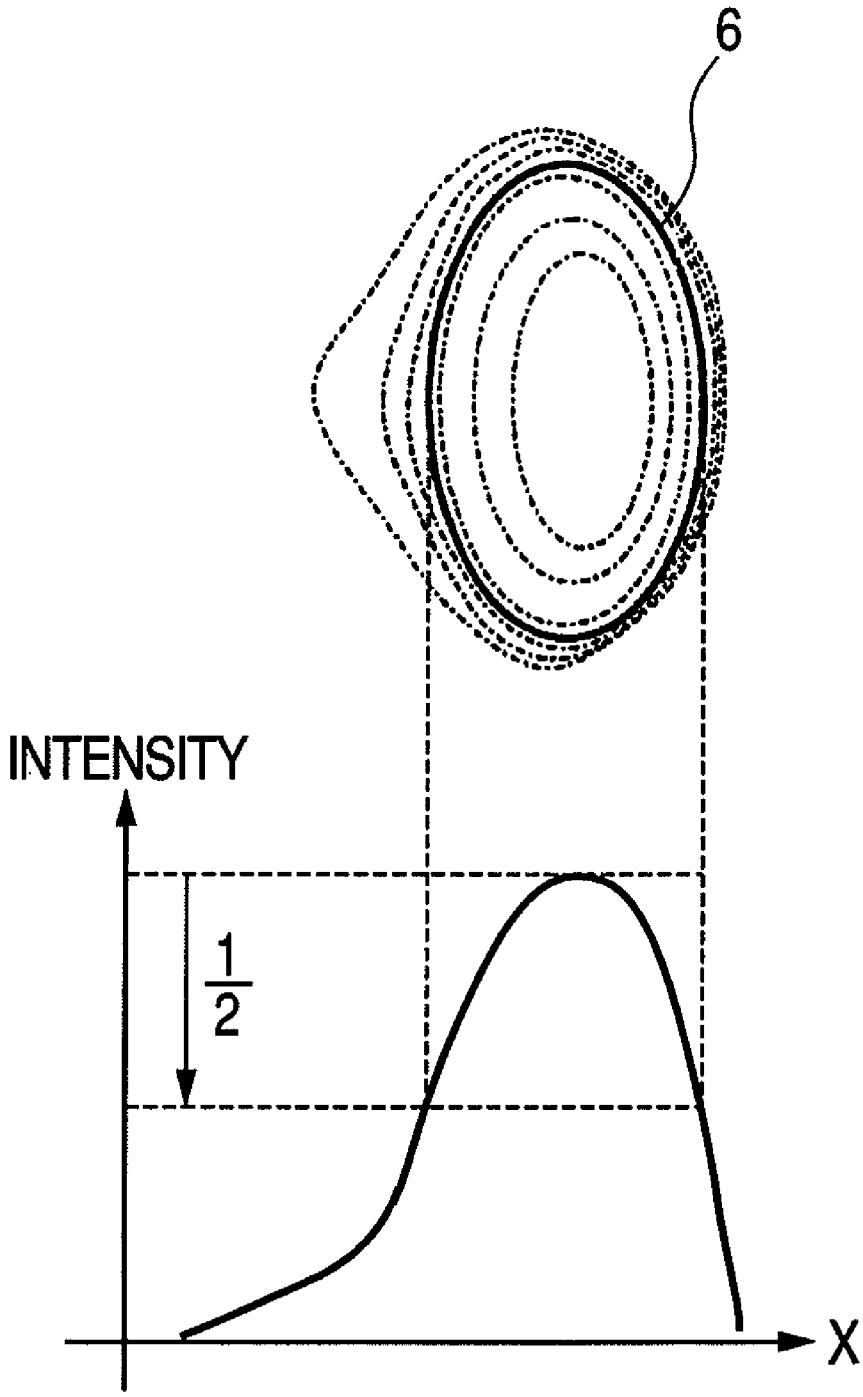
FIG. 2 is a diagram illustrating an electron beam irradiating region and an intensity profile.

FIG. 2 is a schematic diagram illustrating an intensity of the electron beam. In the electron beam display, irradiation intensity distribution of the electron beam does not become uniform but has various distribution patterns. Although the irradiation intensity distribution of the electron beam differs depending on a shape of the electron-emitting device 10, typical distribution in the case where the surface conduction electron-emitting device is used is illustrated in FIG. 2. The lower graph is an intensity profile of a cross section in the X direction. The electron beam irradiation intensity profile of the surface conduction electron-emitting device has a peak and the outside of the peak changes gently. Since the irradiation intensity distribution of the electron-emitting device changes gently in a predetermined direction as mentioned above, it is difficult to clearly show a non-irradiating portion of the electron beam and the region where the light emission is strongly performed is limited. In the present invention, therefore, it is assumed that the light-emitting region by the electron beam is a portion having the intensity which is equal to or more than the half of the peak intensity in the irradiation intensity distribution of the electron beam.

Depending on the phosphor which is used, there is a case of occurrence of such a phenomenon that the more what are called gamma characteristics, that is, a current density that is excited is increased, the more light-emitting efficiency decreases and a luminance saturation occurs. In such a case, the irradiation intensity profile of the electron beam and the light-emitting intensity profile do not coincide strictly. However, it is an object of the present invention to efficiently extract the light emitted from the phosphor. The region obtained from the region of the half of the peak in the light-emitting profile is set to an electron beam irradiating region 6. However, when a plurality of apertures 8, which will be described hereinlater, are arranged in this instance, there is a case where it is difficult to observe the light-emitting profile from the outside of the face plate 1. In such a case, the electron beam irradiating region 6 is obtained by the following method and a plurality of apertures are arranged for the region 6.

(1) The profile which can be observed from a plurality of apertures 8 is measured.

(2) A prediction profile of the electron beam which is presumed from a shape of the electron-emitting source, a shape of the rear plate, the accelerating voltage, and the like is measured.

(3) A beam profile is measured by using the face plate in which the apertures are large or the black member 3 does not exist.

In order to efficiently extract the light from the phosphor 2 as an object of the present invention, it is necessary to pay attention to the light-emitting intensity in the phosphor 2.

A size of electron beam irradiating region 6 is smaller than a size of pixel 7 (there is also a case where it is called a sub-pixel) and the electron beam is irradiated to the almost fixed region. In the electron beam display of the fixed pixel type, since the electron beam irradiating region 6 is smaller than the pixel 7, it is necessary to consider the light extracting method. In the CRT, the electron beam is deflected by a deflecting coil and scanned, thereby displaying an image. Therefore, the electron beam is irradiated to the whole pixel in the direction in parallel with the scanning direction. In the CRT having a shadow mask or the like, however, there is a case where the electron beam irradiating region 6 is limited. In such a case, the present invention can be also desirably used. That is, the present invention can be desirably used so long as such an electron beam display that the position/region of the electron beam which is irradiated to the face plate is limited to a certain portion.

Subsequently, a method of improving the light extracting efficiency when a plurality of apertures 8 are formed will be described.

Figure 3A:
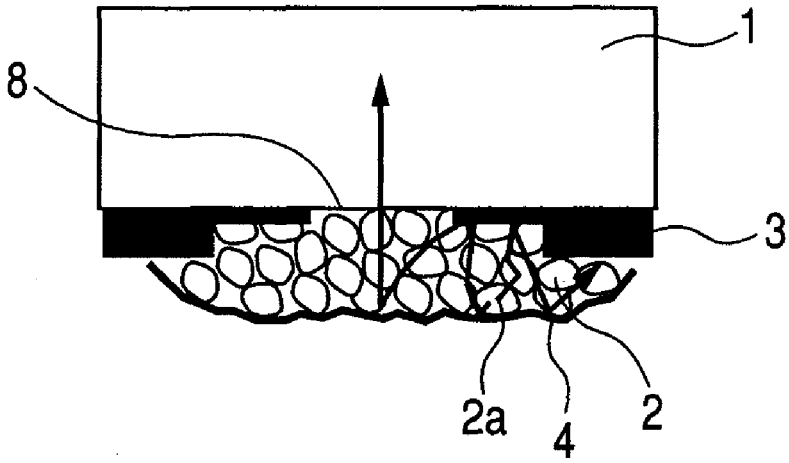
FIGS. 3A and 3B are diagrams schematically illustrating a progressing state of light emitted from phosphor in a face plate having a black member in which only one aperture is formed on one side of phosphor which has emitted light.
Figure 3B:
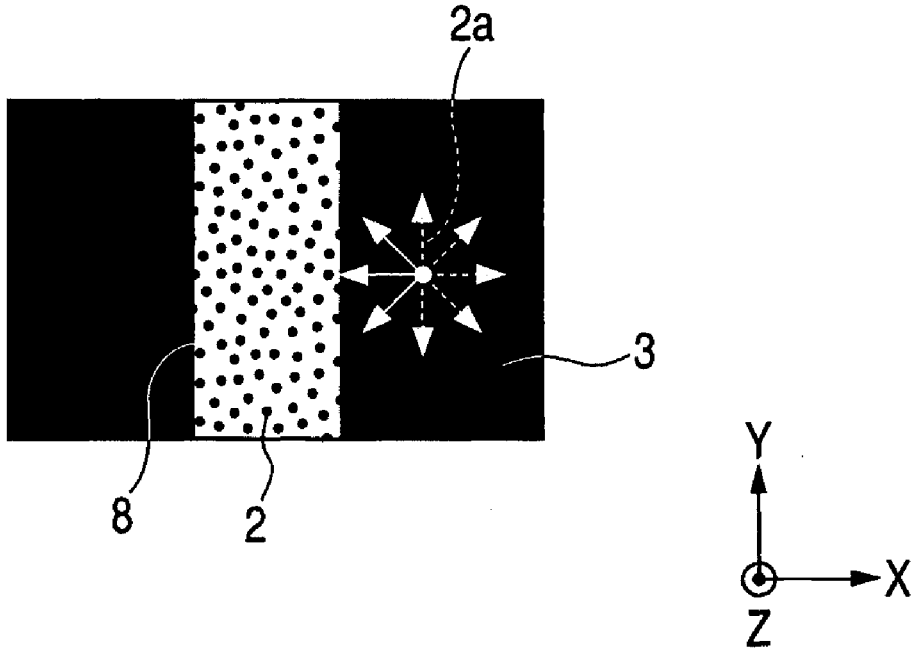
Figure 4A:
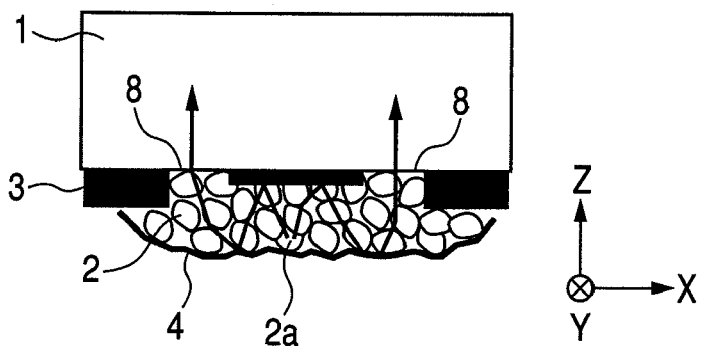
FIGS. 4A, 4B and 4C are diagrams schematically illustrating a progressing state of light emitted from phosphor in a face plate having a black member in which apertures are formed on both sides or a periphery of phosphor which has emitted light.
Figure 4B:
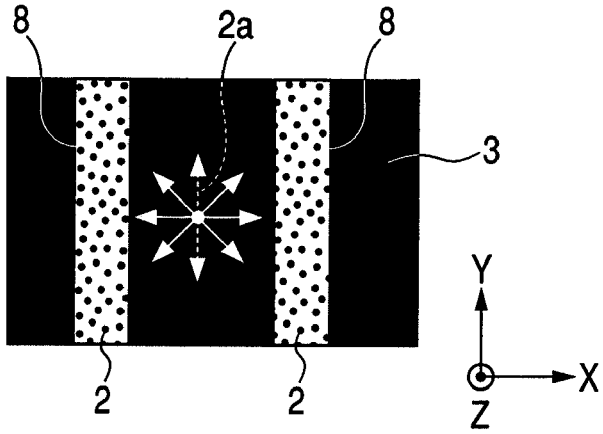
Figure 4C:
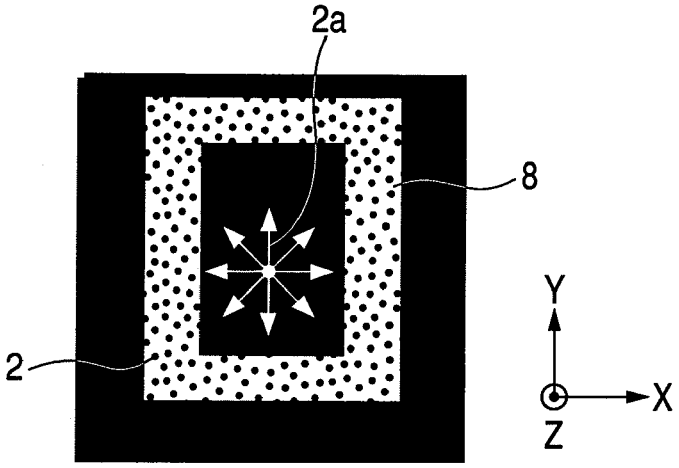

A plurality of apertures 8 are formed to extract the light emitted by the irradiation of the electron beam mentioned above. First, an effect which is obtained by providing the plurality of apertures will be described with reference to FIGS. 3A, 3B, 4A, 4B and 4C. Each of FIGS. 3A and 4A is a diagram illustrating a cross section of the face plate. Each of FIGS. 3B, 4B, and 4C is a plan view when seen from the outside (observer side) of the face plate.

A light beam from phosphor 2*a* which has emitted the light by the irradiation of the electron beam mentioned above is shown by an arrow in each diagram. The emitting direction of the light beam from the phosphor 2*a* is isotropic. The phosphor 2*a* in the phosphor 2 is phosphor which is not located just under the aperture 8 but exists at a position hidden by the black member 3.

In the example illustrated in FIG. 3A, only one aperture 8 is formed on the left side of the phosphor 2*a* which has emitted the light by the irradiation of the electron beam.

In such a construction, the light beams (shown by arrows which progress to the left from the phosphor 2*a*) emitted in the direction toward the aperture 8 are scattered and reflected by the phosphor 2 and the metal back 4 and most of the light beams can be emitted from the aperture 8. However, in the case of the light beams (shown by arrow which progress to the right from the phosphor 2*a*) emitted to the side opposite to the aperture 8, even they are scattered and reflected by the phosphor 2 and the metal back 4, the light beams are difficult to reach the aperture 8. Even if the light beams reached the aperture 8, the light has been attenuated due to the scattering and reflection of the considerable number of times.

As illustrated in FIG. 3B, the light beams from the phosphor 2*a* which has emitted the light by the irradiation of the electron beam are emitted in various directions on the XY plane. In this instance, in the case where the aperture 8 is arranged only one side of the phosphor 2*a* which has emitted the light, the light beams shown by solid lines are directed to the aperture and the light beams shown by broken lines are not directed to the aperture 8. Although there is a case where the light beams shown by the broken lines also reach the aperture 8 after they were scattered and reflected, they are accompanied with the large attenuation during the scattering and reflection of many times.

In the example illustrated in FIG. 4A, the apertures 8 are formed on both right and left sides of the phosphor 2*a*.

In such a construction, the light beams (shown by arrows which progress to both of the right and left from the phosphor 2*a*) emitted from the phosphor 2*a* are liable to reach the aperture 8 before the light is attenuated by the scattering and reflection. In this manner, it is desirable that both of the right and left sides of the phosphor 2*a*, in other words, the light-emitting portions are arranged at the sandwiched positions in the X direction in the aperture 8.

As illustrated in FIG. 4B, when the apertures 8 are formed on both sides of the phosphor 2*a* which emits the light, the light beams shown by solid lines and progress to the right and left can reach the aperture 8. Naturally, although there is also a case where the light beams which progress in the Y direction which is shown by broken lines and is parallel with the aperture 8 reach the aperture 8 after they were scattered and reflected, they are accompanied with the large attenuation during the scattering and reflection of many times.

In the example illustrated in FIG. 4C, the apertures 8 are formed so as to surround the periphery of the phosphor 2*a*.

In such a construction, the light beams emitted from the phosphor 2*a* are liable to reach the aperture 8 in any of the X and Y directions. The number of apertures 8 is not always limited to the plural number but the aperture 8 may be formed in a continuous coupled form.

Subsequently, shapes and positions of the apertures 8 for the electron beam irradiating region as a feature of the present invention will be described.

In the embodiment in which the electron beam irradiating region 6 is smaller than the phosphor dot 20, by using the following construction, the light extracting efficiency and the bright-portion contrast can be improved.

As mentioned above, in order to improve the light extracting efficiency, it is required that the aperture 8 exists outside of the region where the light emission is performed. For this purpose, it is constructed so that at least a part of the aperture 8 is located outside of the electron beam irradiating region 6.

In order to improve the bright-portion contrast, it is necessary to increase the occupation ratio of the black member 3 which can absorb the external light, that is, decrease the aperture ratio. For this purpose, it is constructed so that a part of the black member 3 is located in the electron beam irradiating region 6.

Specific examples of such a construction will be described hereinbelow.

As a first construction, there is considered a construction in which the aperture 8 is divided into a plurality of apertures and at least one of the divided apertures 8 is arranged outside of the electron beam irradiating region 6 so as to sufficiently surround the electron beam irradiating region.

Figure 5A:
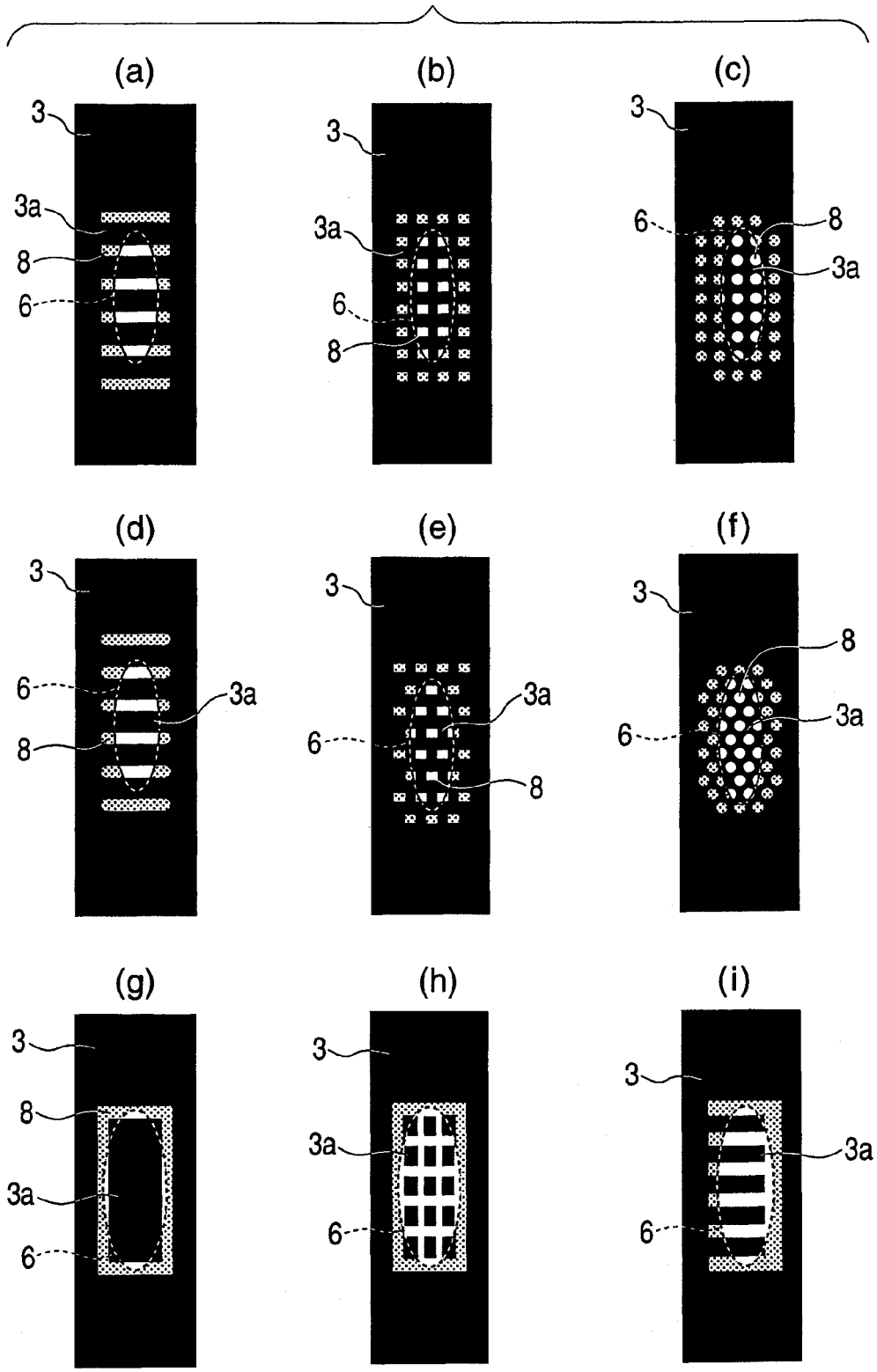
FIG. 5A is a schematic plan view illustrating examples of black members in each of which apertures having such a shape that can obtain an effect of the present invention.

As examples of such a construction, constructions illustrated in (a) to (f) in FIG. 5A can be mentioned. In each diagram, the electron beam irradiating region 6 is illustrated by a vertically elongated elliptical shape. Although not illustrated in the diagrams, the phosphor dots 20 are arranged in the region including all apertures 8 and all black members 3*a* locating among the apertures 8.

(a) in FIG. 5A illustrates an example in which a plurality of rectangular apertures 8 are arranged in parallel so to form a predetermined interval therebetween. More specifically speaking, in this example, although six apertures are arranged in parallel in the short-sided direction of the rectangle, the electron beam irradiating region 6 does not reach the apertures 8 locating at both of the upper and lower edges and the electron beam irradiating region 6 is located only in the four inside apertures 8. That is, in the major-axial direction of the elliptical electron beam irradiating region 6, the apertures 8 are arranged in a region wider than the major axis.

A length in the longitudinal direction of the rectangular aperture 8 is longer than the minor axis of the elliptical electron beam irradiating region 6.

By forming such apertures 8 in the black member 3, the apertures 8 are made to exist outside of the light-emitting region and the occupation ratio of the black member 3*a* which can absorb the external light is increased, thereby enabling the aperture ratio to be reduced. That is, the light extracting efficiency can be improved and the bright-portion contrast can be improved.

(b) in FIG. 5A illustrates an example in which a plurality of square apertures 8 are arranged in a matrix form so to form a predetermined interval therebetween. An aperture area of each of the square apertures 8 is smaller than an aperture area of each of the rectangular apertures 8 in (a) in FIG. 5A. The aperture shape of each aperture 8 is not limited to the square but may be a rectangle or a polygon.

(c) in FIG. 5A illustrates an example in which the apertures 8 each having a circular aperture shape are arranged in a matrix form so to form a predetermined interval therebetween. In (c) in FIG. 5A, the aperture ratio can be more effectively reduced by eliminating the circular apertures in four corners where the light beam hardly reaches. Also in this example, the aperture shape of each aperture 8 is not limited to the circle but may be an ellipse or another aperture shape whose outer periphery is formed by a curve.

Figure 5B:
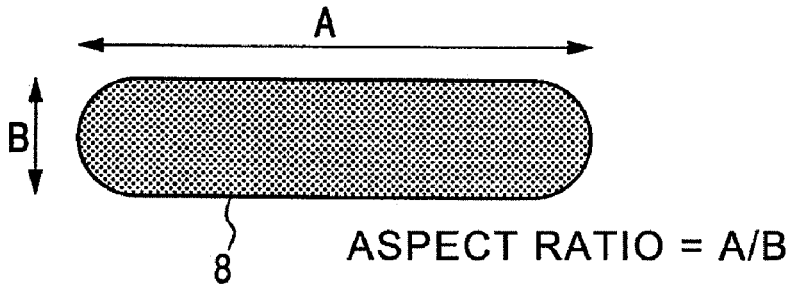
FIG. 5B is a diagram for describing an aspect ratio of the aperture.

Although (d) in FIG. 5A has a construction almost similar to that illustrated in (a) in FIG. 5A, (d) illustrates an example in which corners of each aperture 8 are rounded. As a wider definition, it is desirable that each aperture has a shape of a large aspect ratio (refer to FIG. 5B).

According to such a layout of such an aperture 8, as illustrated in FIG. 4B, in the light emitted from a certain point, the light which is emitted in most of the directions can be extracted from the aperture.

(e) in FIG. 5A illustrates an example in which a plurality of square apertures 8 are arranged in a zigzag form so to form a predetermined interval therebetween.

(f) in FIG. 5A illustrates an example in which a plurality of circular apertures 8 are arranged in a zigzag form so to form a predetermined interval therebetween.

Subsequently, as a second construction, a construction in which such an aperture as to include the electron beam irradiating region 6 is presumed and the black member 3 is arranged in the electron beam irradiating region 6 is considered in place of the first construction having the divided aperture shapes.

(g) in FIG. 5A illustrates an example in which one black member 3*a* is formed in the aperture 8 whose aperture area is larger than the electron beam irradiating region 6.

(h) in FIG. 5A illustrates an example in which a plurality of rectangular black members 3*a* are arranged in a matrix form in the aperture 8 whose aperture area is larger than the electron beam irradiating region 6.

(i) in FIG. 5A illustrates an example in which a plurality of rectangular black members 3*a* are arranged in parallel in the aperture 8 whose aperture area is larger than the electron beam irradiating region 6. In each of the black members 3*a* in the example illustrated in (i) in FIG. 5A, one of its edge portions is in contact with the periphery of the aperture 8.

Further, a construction of the aperture portion necessary to further improve the light extracting efficiency (layout of the black member, reflecting member, and aperture) will be described.

The light beam emitted from the phosphor which has performed the light emission by the electron irradiation is repetitively subjected to (1) scattering in the phosphor,
(2) reflection by the metal back, and
(3) reflection by the black member and is emitted from the aperture to the observer side. In order to reduce the attenuation amount of the light beam as much as possible, therefore, a method whereby light absorption amounts in the phenomena of (1) to (3) are reduced as much as possible and a method whereby distances at which the phenomena of (1) to (3) occur are shortened are considered. Among (1) to (3), the light absorption amount is largest in the phenomenon of (3).

Figure 6:
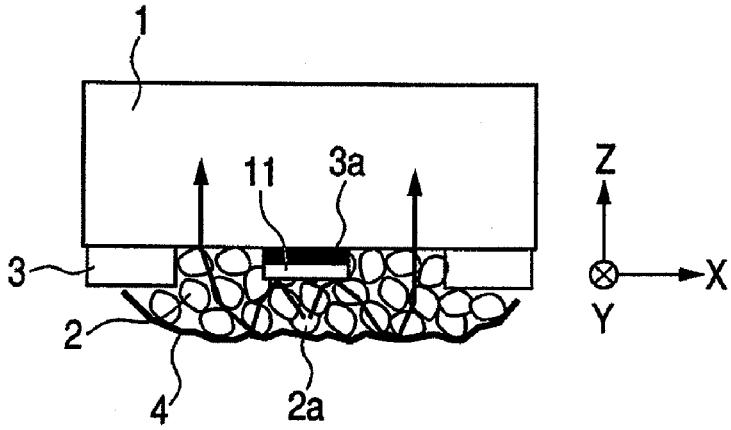
FIG. 6 is a schematic side sectional view of a face plate having a black member with a reflecting member.

Therefore, as illustrated in FIG. 6, by providing a reflecting member 11 on the side of the phosphor 2 (the side in opposition to the phosphor dot 20) of the black member 3*a* disposed in the electron beam irradiating region 6, the light absorption in the black member 3*a* which exerts the largest influence can be reduced. It is more desirable to also provide the reflecting members 11 for the black members 3*a* of the portions other than the black member 3*a* disposed in the electron beam irradiating region 6. However, in the following description, only the black member 3*a* disposed in the electron beam irradiating region 6 will be described for convenience of description.

As a reflecting member 11, a member such as a metal film which performs a mirror reflection or a white colored member using a white colored material such as ceramics which performs a diffuse reflection can be used.

In the case of using the metal film as a reflecting member 11, a metal having a high reflectance can be used and silver, aluminum, nickel, platinum, rhodium, or the like can be desirably used. Particularly, aluminum is desirable because it is cheap, a reflectance is high, and it is also suitable for the photolithography. As a method of producing the reflecting film of the metal by laminating onto the black member 3*a*, a vacuum evaporation depositing method, a transfer method, a plating method, a screen printing method, or the like can be mentioned. As a patterning method, the photolithography, transfer method, screen printing method, or the like can be mentioned. In the case of the screen printing method, a material obtained by mixing microflakes of metal pieces into a paste form is used. Particularly, a method whereby the metal film formed by the vacuum evaporation depositing method is formed in the portion other than the aperture by the photolithography can be desirably used because of easiness of processes.

Subsequently, the case of using the white colored member as a reflecting member 11 will be described. The white colored member is a member having a high diffusion reflectance. It is assumed here that the member whose diffusion reflectance is equal to 50% or more is used as a white colored member. By laminating the white colored member onto the black member 3*a*, the high reflectance can be obtained irrespective of the surface state of the black member 3*a* serving as an underground. As a material of the white colored member, ceramics such as alumina, zirconia, or titania, barium sulfate which is used for the diffusion reflecting plate, or the like can be mentioned. As a method of forming the white colored member, the photolithography, screen printing method, transfer method, or the like using a member obtained by forming a paste from the above material can be mentioned. Among them, particularly, the photolithography using the photosensitive paste of the ceramics can be desirably used because of easiness of processes.

The black member 3*a* and the reflecting member 11 can be also simultaneously patterned. The whole surface is previously coated with the material of the black member 3*a* and, subsequently, the surface is formed as a film or coated with the material of the reflecting member 11. By preliminarily mixing a photosensitive material into those materials and photosensing and developing them in a lump, they can be collectively patterned. Therefore, particularly, the laminate structure of the black member 3*a* and the reflecting member 11 can be desirably formed.

Either a mode to form the metal film onto the black member 3*a* or a mode to form the white colored member can be properly selected according to the surface state of the black member 3*a*. If the black member 3*a* is flat, the metal film by which the mirror reflection can be obtained can be desirably used. When the black member 3*a* is not flat, even if the metal film is formed onto the non-flat black member 3*a*, a glossy surface cannot be obtained and the reflectance decreases. In such a case, it is desirable to use the white colored member such as ceramics or the like in which the high reflectance can be obtained irrespective of the surface state of the black member 3*a* as mentioned above.

Subsequently, a method of improving the light extracting efficiency by shortening a distance until the light is extracted will be described. Naturally, although it is most desirable that the aperture exists in the light-emitted portion, the aperture ratio cannot be reduced by such a construction. However, if the distance (distance between the apertures; length of light-shielded member) of the portion which is light-shielded by the black member 3*a* is short, since the number of times of the scattering in this portion is decreased, an attenuation ratio of the light can be reduced.

A shape suitable to shorten the distance of the portion which is light-shielded by the black member 3*a* will now be described with reference to FIG. 7. The example illustrated in FIG. 7 relates to the construction illustrated in (a) in FIG. 5A.

Figure 7:
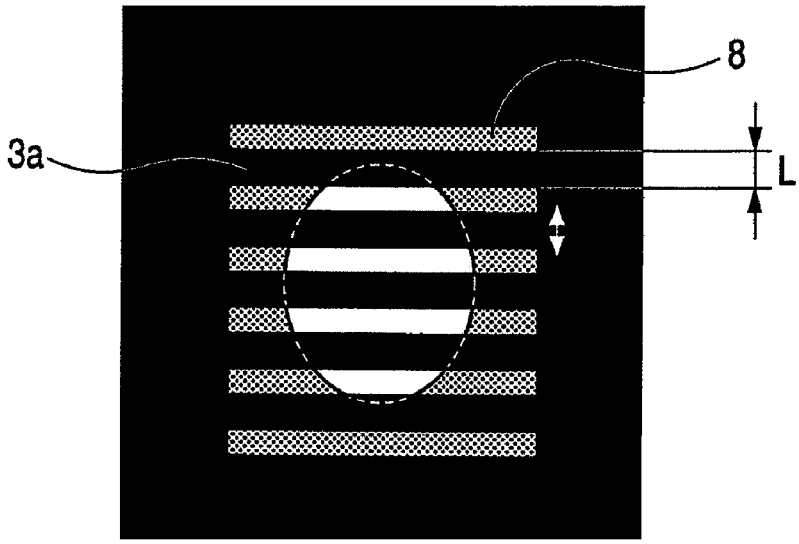
FIG. 7 is a diagram for describing a shape suitable to shorten a distance of a portion which is light-shielded by the black member.

In the example illustrated in FIG. 7, the aperture 8 has a rectangular shape of a large aspect ratio. The black member 3*a* locating between the apertures 8 also has a rectangular shape of a large aspect ratio. By using such a construction, the light emitted from the phosphor 2*a* of the portion which is located between the apertures 8 and is light-shielded by the black member 3*a* can be allowed to reach the aperture by the shortest distance in the case where the light has been emitted in the direction shown by white arrows in the diagram.

The light beams emitted in the other directions also reach the aperture by relatively short distances. In addition, since the aperture ratio can be easily reduced, an effect of raising the bright-portion contrast is large.

In order to improve the bright-portion contrast, particularly, it is desirable to form the aperture 8 into a rectangle of a large aspect ratio (that is, the black member 3*a* also has a rectangular shape of a large aspect ratio). Naturally, when a distance L of the light-shielded portion is too long, even if the light-shielded portion is set into a rectangle of a large aspect ratio, the effect decreases. Therefore, it is desirable that the distance L of the black member 3*a* lies within a certain range. If it is sufficient that a degree of reduction in aperture ratio is small, the shape as illustrated in (h) in FIG. 5A is desirable because the light extracting efficiency can be increased.

Subsequently, a relation between the distance L of the black member 3*a* and the film thickness of the phosphor 2 will be described.

Since the light beam from the phosphor 2 which has been excited by the electron beam and emitted the light is isotropically radiated, it has an extent of a certain degree. The light beam is mainly concerned with the film thickness of the phosphor dot 20 made of the phosphor 2 and is spread to a distance (XY directions) which is about five times as large as the film thickness. Therefore, if the distance L of the black member 3*a* is equal to or larger than five times as large as the film thickness of the phosphor dot 20, since almost all of the light beams are certainly reflected by the black member 3*a*, the light extracting efficiency decreases. It is, therefore, desirable that the distance L of the black member 3*a* is equal to or less than five times as large as the film thickness of the phosphor 2.

Subsequently, the relation between the aperture ratio and the bright-portion contrast will be described. When the aperture ratio is too large, the effect of improving the bright-portion contrast decreases. However, if the aperture ratio is set to be too small, the light extracting efficiency decreases.

The effect of improving the bright-portion contrast starts to appear from a point where the aperture ratio in the electron beam irradiating region 6 is equal to about 90% and it appears typically when the aperture ratio is smaller than 70%. If the aperture ratio in the electron beam irradiating region 6 is smaller than 30%, the light extracting efficiency decreases. If it is smaller than 20%, the luminance is too low. Therefore, by setting the aperture ratio to a value within a range from 20% or more to 90% or less, desirably, a range from 30% or more to 70% or less, the bright-portion contrast can be desirably improved.

Figure 8:
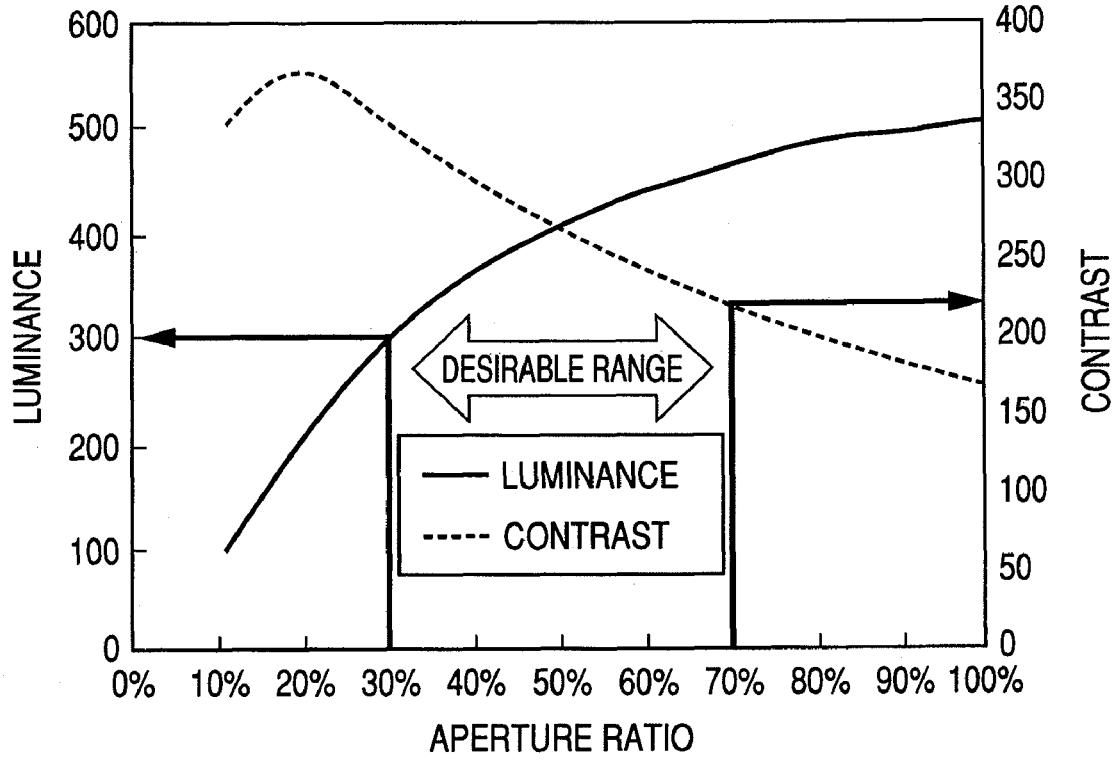
FIG. 8 is a graph illustrating a relation of luminance and contrast to an aperture ratio in the electron beam irradiating region.

FIG. 8 is a graph illustrating a relation of the luminance and the contrast to the aperture ratio in the electron beam irradiating region.

When the aperture ratio is equal to 30%, the luminance decreases to about 60%. When the aperture ratio is set to a value less than 30%, the luminance becomes too dark. On the contrary, if the aperture ratio is equal to about 70%, the effect of improving the bright-portion contrast decreases to about 30%.

The present invention has specifically been described above with respect to the electron beam display using the surface conduction electron-emitting devices. The present invention can be also desirably used in a display using other electron-emitting devices. When the other electron-emitting devices are used, an irradiating region of the electron beam according to them is formed. In the case of the spint type, the irradiating region is formed by a number of spots. In the case of a CRT using the shadow mask, a sharp current density profile having a shape almost similar to that of the aperture portion of the shadow mask is obtained. In this instance as well, by deciding the aperture shape in order to improve the bright-portion contrast for the electron beam irradiating region, the bright-portion contrast can be remarkably improved.

The present invention will be described in detail hereinbelow by showing specific Examples.

EXAMPLE 1

Figure 1B:
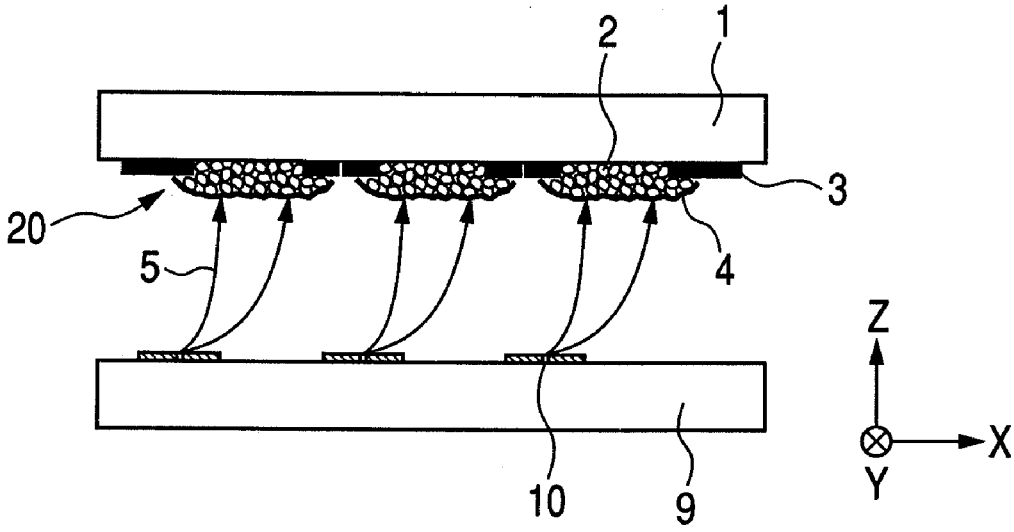

In this Example, the electron beam display having the black member illustrated in FIGS. 1A and 1B is manufactured.

First, a method of manufacturing the face plate 1 showing the feature of the present invention will be described.

<Step 1: Formation of Black Member>

An annealing process is executed to an upper surface of a soda-lime glass substrate and the upper surface is cleaned. After that, the whole surface is coated with a black paste serving as a black member 3 so as to have a thickness of 5 μm. In this Example, carbon black in which a sensitizer has been mixed is used as a black paste. After the coating, an exposure is executed so as to have such a shape as to have a plurality of apertures 8 per subpixel as illustrated in FIG. 1A, a development is executed, and a desired pattern is obtained. A pitch of RGB square pixels is set to 450 μm (a size of subpixel is set to 150 μm in the X direction and 450 μm in the Y direction). A size of one aperture 8 in the subpixel is set to 100 μm in the X direction and 20 μm in the Y direction. A length in the Y direction (distance L) of the black member 3*a* locating between the apertures 8 is set to 20 μm (refer to FIG. 7). The apertures 8 at six positions per subpixel are arranged so as to be aligned in the Y direction. After that, a baking is performed at 450°.

<Step 2: Formation of Reflecting Member>

Subsequently, a film of aluminum is formed as a reflecting member 11 onto the whole surface by the vacuum evaporation depositing method so as to have a thickness of 300 nm. Then, the whole surface is coated with a photoresist and an exposure is performed so that the resists of the portions of the apertures 8 are removed. After that, the resists of the portions of the apertures 8 are removed by a development, the aluminum film is removed by etching, and thereafter, the remaining resists are exfoliated.

<Step 3: Formation of Phosphor>

Subsequently, the phosphor 2 of RGB are formed by the screen printing method. The P22 phosphor made by Kasei Optonix, Ltd. are used as phosphor 2; that is, red P22RE3 ($Y_2O_2S$), green P22GN4 (ZnS: Cu, Al), and blue P22B2 (ZnS: Ag, Cl) are used. A mean diameter of each phosphor 2 is equal to 7 μm and they are formed so that an average film thickness of the phosphor dot 20 is equal to 15 μm. After that, the baking is performed at 450° C.

<Step 4: Formation of Metal Back>

Subsequently, the metal back 4 is formed by using the filming method which is well known in the field of the CRT. After the resin intermediate film was formed, a film of aluminum is formed by the vacuum evaporation depositing method so as to have a thickness of 100 nm. After that, the baking is performed at 450° C. and the resin intermediate film is removed.

<Step 5: Formation of Vacuum Vessel>

The face plate 1 is produced through the foregoing steps and combined with the rear plate 9, thereby forming a vacuum vessel. The operation as an electron beam display was confirmed. A description about the producing methods of the rear plate 9 and the electron-emitting devices 10 is omitted here.

A construction of the surface conduction electron-emitting devices used in the embodiment will now be described.

Figure 9:
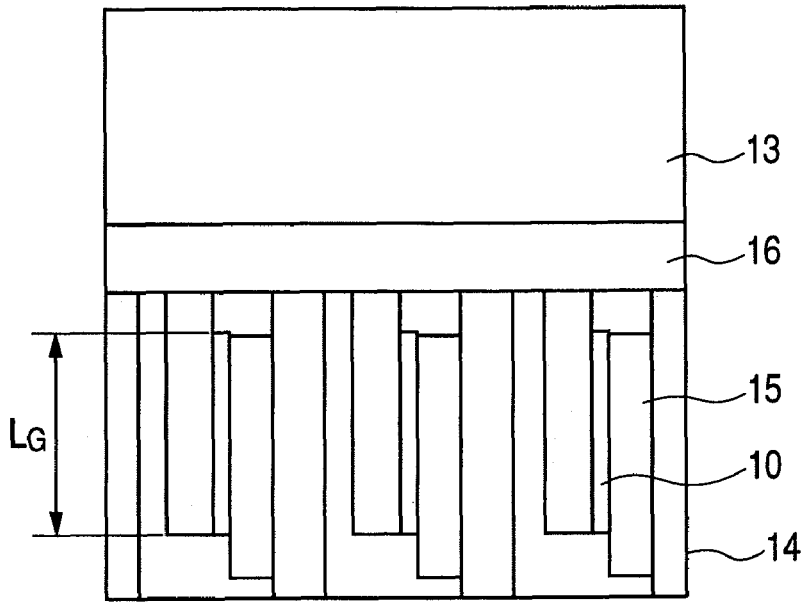
FIG. 9 is a plan view illustrating a part of a construction of a rear plate in an embodiment of the present invention.

FIG. 9 is a plan view illustrating a part of the construction of the rear plate in the embodiment. A scanning line 13 at the time of line-sequentially driving and a signal line 14 are formed on the rear plate 9 and are insulated by an interlayer insulating layer 16. An electrode 15 for supplying a current to the electron-emitting device 10 is connected to each of the scanning line 13 and the signal line 14. A nanogap length $L_G$ of the electron-emitting device 10 is set to 100 μm. A distance between the face plate 1 and the rear plate 9 is set to 2 mm. A light-emitting region by the electron beam which is obtained when the manufactured image display panel has been driven at a device driving voltage of 16V and an accelerating voltage of 10 kV is as illustrated in FIG. 1A.

A luminance of the manufactured electron beam display is measured, so that it is equal to 450 cd/m$^2$. A diffusion reflectance at an illuminance in the room of 300 1× is measured, so that it is equal to 3%. A bright-portion contrast is equal to about 300.

EXAMPLE 2

Example 2 relates to an example in which the white colored material is used as a reflecting member 11. Since a shape of aperture 8, producing methods of the phosphor 2 and the metal back 4, and the like are similar to those in Example 1, their description is omitted.

<Formation of Black Member and Reflecting Member>

An annealing process is executed to a soda-lime glass substrate and the substrate is cleaned. After that, the whole surface is coated with a black paste serving as a black member 3 so as to have a thickness of 5 μm. In this Example, a paste obtained by mixing a sensitizer, a binder resin, a black pigment, and a glass frit of a low melting point is used as a black paste.

Subsequently, the whole surface is coated with a white paste so as to have a thickness of 5 μm. In this Example, a paste obtained by mixing a sensitizer, alumina, and a glass frit of a low melting point is used as a white paste.

After the white paste was laminated and coated, a drying is performed, an exposure is executed so as to have a desired shape, and a development is performed, thereby obtaining the pattern as illustrated in FIG. 1A. After that, the baking is performed at 450° C.

Subsequently, the phosphor and the metal back are formed by a method similar to that of Example 1.

A luminance of the manufactured electron beam display is measured, so that it is equal to 420 cd/m$^2$. A diffusion reflectance at an illuminance in the room of 300 1× is measured, so that it is equal to 3%. A bright-portion contrast is equal to about 280.

(Comparison)

Figure 10A:
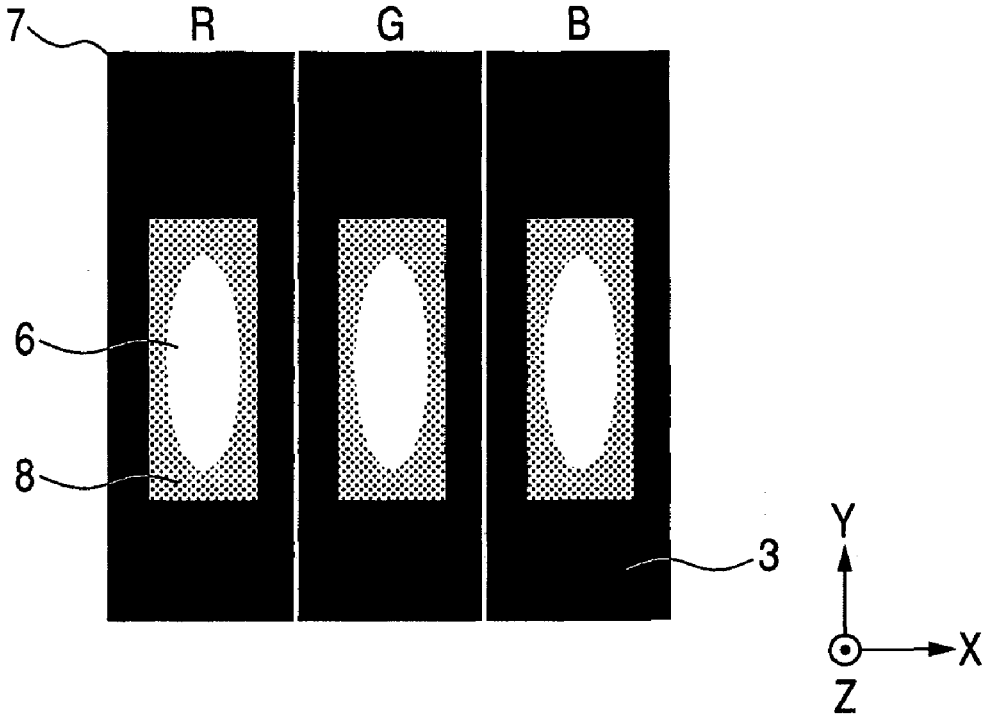
FIGS. 10A and 10B are a schematic plan view and a schematic cross sectional view of an electron beam display as a comparison example.
Figure 10B:
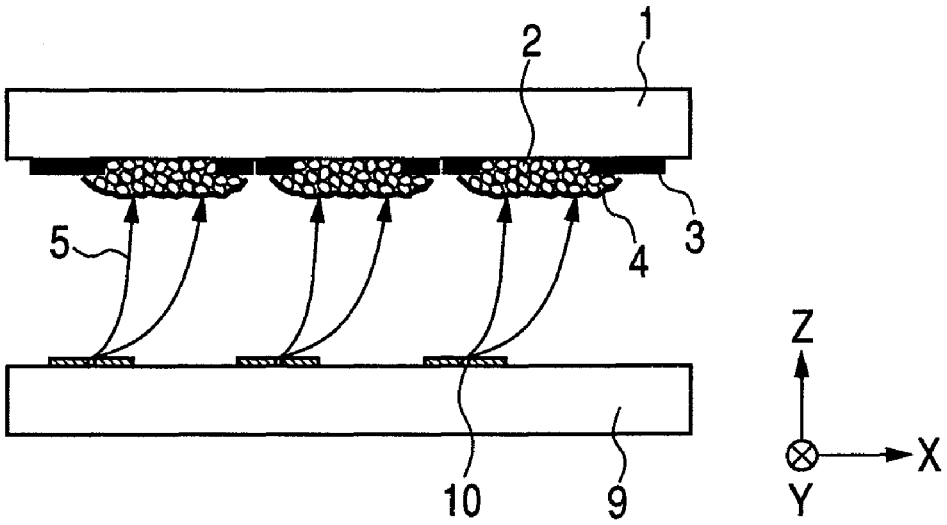

Subsequently, as a Comparison, the black member 3 formed with the aperture 8 which covers the whole electron beam irradiating region 6 illustrated in FIGS. 10A and 10B is manufactured. A manufacturing method and the like are similar to those in Example 1 except that only the shape of aperture 8 differs. One aperture 8 is provided for each subpixel and the aperture 8 has a rectangular shape including the electron beam irradiating region 6. Dimensions of the aperture are set to 100 μm in the X direction and to 220 μm in the Y direction.

A luminance of the manufactured electron beam display is measured, so that it is equal to 500 cd/m$^2$. A diffusion reflectance at an illuminance in the room of 300 l× is measured, so that it is equal to 6%. A bright-portion contrast is equal to about 170.

While the present invention has been described with reference to exemplary embodiments, it is to be understood that the present invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-097025, filed Apr. 3, 2008, which is hereby incorporated by reference herein in its entirety.

What is claimed is:

1. An electron beam display comprising:

an electron source;

a face plate provided with a metal back, a phosphor layer being disposed in opposition to the electron source through the metal back and emitting light responsive to an irradiation with an electron beam emitted from the electron source, and a black member being disposed in opposition to the electron source through the phosphor layer and having an aperture in a region in which the phosphor layer is formed, wherein a region irradiated with the electron beam emitted from the electron source is not larger than the phosphor layer, a part of the black member is disposed in the region irradiated with the electron beam, and at least a part of the aperture is disposed outside of the region irradiated with the electron beam.

2. The electron beam display according to claim 1, wherein a plurality of the apertures are formed, and at least one of the apertures is disposed outside of the region irradiated with the electron beam.

3. The electron beam display according to claim 2, wherein the plurality of the apertures are arranged to form a predetermined interval therebetween.

4. The electron beam display according to claim 2, wherein each of the plurality of the apertures is formed in a rectangular shape.

5. The electron beam display according to claim 3, wherein the predetermined distance is not larger than five times of a film thickness of the phosphor layer.

6. The electron beam display according to claim 2, wherein the plurality of the apertures in the region irradiated with the electron beam have an aperture ratio of 30 to 70%.

7. The electron beam display according to claim 1, wherein the black member at least disposed inside the region irradiated with the electron beam has, at a side opposing the phosphor layer, a reflecting member reflecting light emitted from phosphor forming the phosphor layer.

8. The electron beam display according to claim 7, wherein the reflecting member is a metal film.

9. The electron beam display according to claim 7, wherein the reflecting member is formed from a white colored material.

* * * * *